US007893628B2

(12) United States Patent
Weger et al.

(10) Patent No.: US 7,893,628 B2
(45) Date of Patent: Feb. 22, 2011

(54) ELECTRONIC CIRCUIT FOR OPERATING A PLURALITY OF GAS DISCHARGE LAMPS AT A COMMON VOLTAGE SOURCE

(75) Inventors: Robert Weger, Wels (AT); Masaya Yamashita, Miyota-machi (JP)

(73) Assignee: Minebea Co., Ltd., Nagano-Ken (JP)

( * ) Notice: Subject to any disclaimer, the term of this patent is extended or adjusted under 35 U.S.C. 154(b) by 536 days.

(21) Appl. No.: 11/975,430

(22) Filed: Oct. 19, 2007

(65) Prior Publication Data

US 2008/0116821 A1 May 22, 2008

Related U.S. Application Data

(60) Provisional application No. 60/860,684, filed on Nov. 22, 2006.

(51) Int. Cl.
*F02P 3/04* (2006.01)

(52) U.S. Cl. ..... 315/209 T; 315/209 R

(58) Field of Classification Search ..... 315/88–90, 315/177, 185 R, 189, 193, 209 R, 210, 226, 315/209 T, 246, 250, 287, 291, 299, 312, 315/313, 320, 324, 326

See application file for complete search history.

(56) References Cited

U.S. PATENT DOCUMENTS

| | | | | |
|---|---|---|---|---|
| 4,272,807 | A * | 6/1981 | Gallagher | 363/126 |
| 4,998,074 | A * | 3/1991 | Van Lammeren et al. | 330/252 |
| 6,420,839 | B1 | 7/2002 | Chiang | |

FOREIGN PATENT DOCUMENTS

| | | |
|---|---|---|
| EP | 1951006 | 7/2008 |
| JP | 2004-071226 | 3/2004 |

* cited by examiner

*Primary Examiner*—Douglas W Owens
*Assistant Examiner*—Jianzi Chen
(74) *Attorney, Agent, or Firm*—Cooper & Dunham LLP

(57) ABSTRACT

The presented circuit makes it possible to operate a plurality of gas discharge lamps, particularly cold cathode tubes, at a common voltage source. The uniform distribution of current to all the lamps is achieved without using any magnetic components, but only using semiconductor components.

14 Claims, 5 Drawing Sheets

ELECTRONIC CIRCUIT FOR OPERATING A PLURALITY OF GAS DISCHARGE LAMPS AT A COMMON VOLTAGE SOURCE

CROSS-REFERENCE TO RELATED APPLICATION

This application claims the benefit of U.S. Provisional Application No. 60/860,684, filed Nov. 22, 2006.

BACKGROUND OF THE INVENTION

The invention relates to an electronic circuit, particularly a semiconductor circuit, for operating a plurality of gas discharge lamps at a common voltage source.

PRIOR ART

Along with the very rapid development of liquid crystal displays (LCDs), there has also been a corresponding demand for suitable wide-coverage sources of light used as backlighting for these displays. The specific requirements for these backlights particularly include uniform light emission over the entire surface and high light yield. At present, fluorescent gas discharge lamps, in particular, are used as these light sources. On the one hand, these lamps achieve a high light yield for white light (50-100 lumen/watt) and, on the other hand, extensive experience with fluorescent gas discharge lamps is available in the field of lighting engineering. Substantial progress has also been made in recent years with regard to the light yield of light-emitting diodes (LEDs), although this technology is considerably more expensive and thus limited to smaller displays. What is more, the linear geometry of fluorescent gas discharge lamps makes it is easier to achieve extensive homogenization of their light compared to point sources of light such as LEDs. In the display unit of a flat screen (LCD) according to the current prior art, behind the fluid crystal unit there is a diffuser plate for light and behind this a plurality of cold cathode gas discharge tubes, disposed in a regular fashion and aligned horizontally. Small-scale homogenization of light is effected by the diffuser plate. For large-scale homogenization, it is crucial that each fluorescent tube emits the same amount of light. The variance in parts that is achievable nowadays in the lamp characteristics is already so small that sufficient light homogeneity may be achieved by merely keeping the individual lamp currents equal. For a longer useful lamp life, it is necessary to operate the lamp with an alternating voltage. For maximum light yield, operating frequencies of over 10 kHz are required. In order to keep the magnetic components small, operating frequencies of over 30 kHz are usually preferred. An upper limit for the operating frequency, particularly for long gas discharge lamps, is given by the parasitic capacitive currents that flow from the lamp to the housing, thus allowing the end of the gas discharge lamp situated at the high voltage side to shine more brightly. The gas discharge lamps are supplied with a typical voltage of 1000 volts and have a typical current consumption of several Milliamperes.

This therefore gives rise to the general technical problem of operating all the gas discharge lamps at the same individual alternating current. An obvious technical solution is to provide each individual lamp with its own regulated power supply having its own high voltage transformer and its own regulation loop. Although this approach works well, it is expensive due to the huge number of required components. Developments in recent years have been particularly aimed at supplying all the lamps from one central high voltage source.

Due to the specific form of the current/voltage characteristic of gas discharge lamps, particularly the negative differential resistance at the operating point, it is not possible to simply connect several lamps in parallel. However, it is possible to operate several gas discharge lamps La at a common voltage source U~ with the aid of balancing transformers Tr. The classical approach using cascaded balancing transformers is realized in the Ushijima balancer. Other improvements on the same basic idea have recently been introduced as the Newton balancer, the Chen balancer and finally the Jin balancer (see FIG. 1) (e.g. WO 2005/038828). Although these passive current balancing methods represent an important step forward, they still include the shortcoming of using a relatively high number of magnetic components, which account for a considerable share in the overall costs of the lamp control circuit.

U.S. Pat. No. 7,042,171 reveals electronic circuits which achieve a uniform distribution of current in the gas discharge lamps La using only semiconductors and not including any magnetic components whatsoever (see FIG. 2). This patent applies the classical idea of the transistor-based current mirror technique directly to balancing lamp currents. An important functional limitation of the circuit provided in U.S. Pat. No. 7,042,171 results from the fact that the classical circuit revealed here only lets the positive half cycle through and a further limitation is that the balancing effect for the collector currents can only be achieved when the lead channel (channel 1 in all illustrations in U.S. Pat. No. 7,042,171), which also delivers all base currents, is situated at that lamp that has the greatest resistance at the operating point concerned. However, the lamp having the greatest resistance at the operating point is not known in advance and, moreover, during operation the lamps may swap this role.

SUMMARY OF THE INVENTION

It is the object of the present invention to provide a circuit that makes it possible to operate a plurality of gas discharge lamps at a common voltage source, the current distribution to the individual lamp branches (current balancing) being achieved entirely without the use of magnetic components, and using only semiconductor parts.

This object has been achieved by an electronic circuit having the characteristics outlined.

Preferred embodiments and further advantageous characteristics of the invention are cited in the subordinate claims.

A first preferred embodiment of the invention relates to a circuit to operate a plurality of gas discharge lamps at a common ac voltage source for defined current distribution to the individual lamp branches, in which for each gas discharge lamp (lamp branch) one npn transistor and one pnp transistor are used as the central components. The input ac voltage through each lamp is separated into their positive and negative half cycles using diodes. The positive half cycle is conducted back to the alternating voltage source via the collector-emitter section of an npn transistor and an emitter resistor. The negative half cycle is conducted back to the voltage source via the collector-emitter section of a pnp transistor and an emitter resistor. The base terminals of all npn transistors are either electrically connected directly to one another or via individual base resistors. The base terminals of all pnp transistors are either electrically connected directly to one another or via individual base resistors. The base currents of the interconnected transistors are derived from the lamp current of one gas discharge lamp (of one lamp branch)—more precisely, the gas discharge lamp having the lowest actual impedance—and have to overcome a Zener diode or an equivalent potential step.

A second preferred embodiment of the invention relates to a circuit to operate a plurality of gas discharge lamps at a common alternating voltage source for defined current distribution to the individual lamp branches, in which for each gas discharge lamp (lamp branch) either two npn transistors or two pnp transistors are used as the central components. For each gas discharge lamp (each lamp branch), a half cycle of the input ac voltage is conducted through the lamp and a first transistor via a first diode, and the other half cycle is conducted through the lamp and a second transistor via a second diode. The base terminals of all first transistors are either electrically connected directly to one another or via individual base resistors. Likewise, the base terminals of all second transistors are either electrically connected directly to one another or via individual base resistors. The base currents of the interconnected transistors are derived from the lamp current of one gas discharge lamp (of one lamp branch)—more precisely, the gas discharge lamp having the lowest actual impedance—and have to overcome a Zener diode or an equivalent potential step.

In one embodiment of the invention, each of the transistors may have an element or circuit part between the base and the collector terminal that generates a voltage potential step and has high impedance below a specific voltage potential and low impedance above this level. Alternatively, for the first group of transistors interconnected at their bases, only one common element or circuit part that generates a voltage potential step may be provided. In the same way, for the second group of transistors interconnected at the bases, only one common element or circuit part that generates a voltage potential step may be used.

The base terminal of each transistor can be either directly connected to the rest of the circuit or connected via a resistor. However, the base terminal may also be connected to the rest of the circuit via a resistor and a capacitor connected in parallel to the resistor.

For balancing the charge in each lamp current branch associated with a gas discharge lamp, a capacitor can preferably be connected in series to the relevant gas discharge lamp.

The base currents for the transistors interconnected at their bases can also be delivered from external voltage sources via an additional transistor that is connected at its base terminal to an element that generates a voltage potential step.

On the other hand, the base currents for the transistors interconnected at their bases may be supplied using an additional circuit taking the form of a multiplying current mirror. Through the additional circuit, small fractions of the emitter currents of the lamp current branches are conducted back to the respective base terminals until the first transistor enters a saturated state. The additional circuit keeps the entire circuit stabilized in this state.

DESCRIPTION OF PREFERRED EMBODIMENTS OF THE INVENTION

Figure 1:
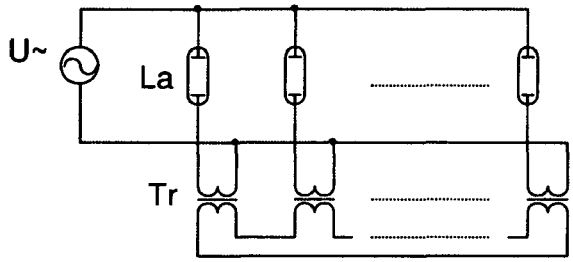
Fig. 1 Prior Art
FIG. 1 schematically shows a circuit for balancing a current using balancing transformers (prior art).
Figure 2:
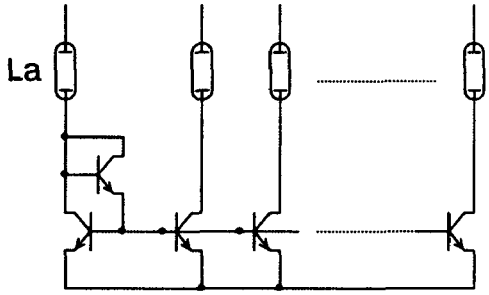
Fig. 2 Prior Art
FIG. 2 schematically shows a circuit for balancing a current using semiconductor circuits (prior art).
Figure 3:
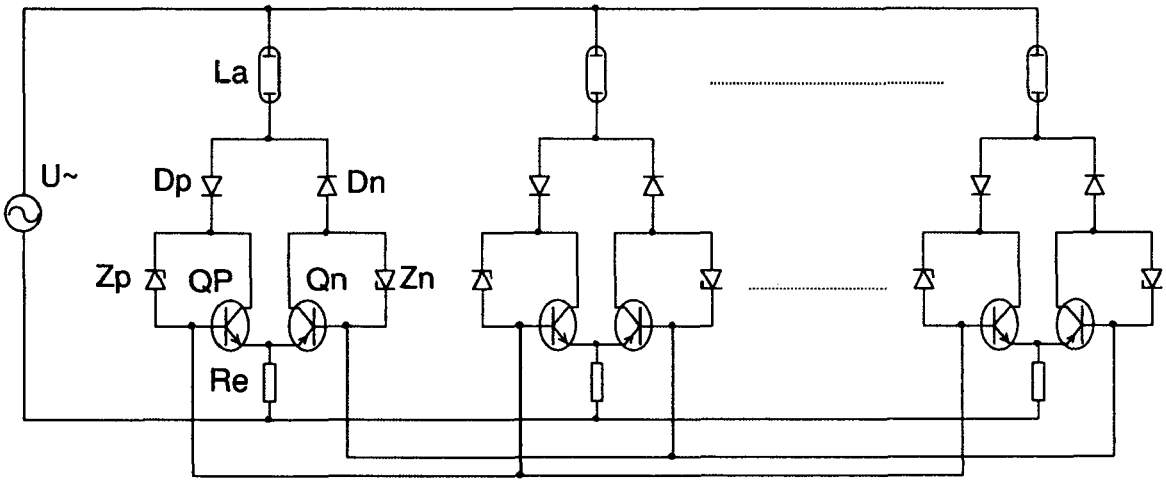
FIG. 3 schematically shows an embodiment according to the invention of a circuit for balancing a current using semiconductor circuits.

FIG. 3 shows a first preferred embodiment of the invention in which for each gas discharge lamp La (lamp branch) an npn transistor Qp and a pnp transistor Qn are used as central components. Generally speaking, each lamp branch or channel respectively has the following part circuit: two diodes Dp and Dn separate the ac voltage U~ across the lamp La into its positive and negative current half cycles. The ac voltage U~ is supplied by a high voltage source, such as a high voltage transformer. The positive half cycles go through the npn transistor Qp, the negative through the pnp transistor Qn. Both the positive and the negative half cycles are conducted back to the transformer via an emitter resistor Re common to the two transistors Qp, Qn. In some applications it might also be advantageous to provide separate emitter resistors for each transistor Qp and Qn. The bases of all npn transistors Qp are connected to one another (p-current mirror). All the bases of the pnp transistors Qn are likewise connected to one another (n-current mirror). The base terminal of each npn transistor Qp is connected using a Zener diode Zp to the collector terminal of the same transistor Qp. The base terminal of each pnp transistor Qn is connected using a Zener diode Zn to the collector terminal of the same transistor Qn. All Zener diodes Zp and Zn have the same nominal Zener voltage, typically in the range of 100-300 volts. These Zener diodes Zp, Zn are of crucial importance to the functioning of the circuit because the current separating effect of the circuit is still present even if the channel having the highest impedance is not known or if it should change during operation. The classic current mirror circuit as proposed in U.S. Pat. No. 7,042,171 (FIG. 4 in that document) realizes current distribution only when the channel having the highest impedance is used as the lead channel (channel 1 in the drawings included there). This considerable functional limitation is overcome by utilizing the Zener diodes according to the invention.

The technical function of the circuit illustrated in FIG. 3 can be described as follows: as long as the voltage drop between the collector and emitter of the transistors Qp and Qn lies below the Zener voltage of the Zener diodes Zp and Zn, all the transistors are blocked since no base current flows. If the voltage half cycle of the common lamp supply voltage U~ now rises, the Zener voltage is first reached in the channel having the lamp La with the lowest impedance, and the relevant Zener diode Zp or Zn respectively becomes conductive. Since the bases of all npn or pnp transistors Qp and Qn are connected to one another, all the interconnected transistors Qp or Qn are triggered via the Zener diode that first becomes conductive and their base currents begin to flow. The Zener diode that is the first to become conductive thus triggers all the bases of the transistors interconnected at their bases, one Zener diode for the positive and one Zener diode for the negative half cycle respectively. At this stage, the collector voltages at the other lamp channels having high resistance are slightly lower than the Zener voltage. Due to identical base voltages (the bases are connected directly) and the same emitter resistance, the emitter currents in all transistors Qp or Qn respectively interconnected at their base are identical. As long as none of the transistors enters saturation, i.e. none are fully switched on, the same applies to the collector currents and thus to the lamp currents as well. In this case, the lamp currents are kept the same size (balanced) by the circuit. The circuit loses its function of uniformly distributing the current as soon as the difference in voltage between the collector and the emitter in one of the channels approaches zero. This situation is more likely to occur the lower the level of the Zener voltage and the greater the tolerance in the lamp characteristic. By choosing a sufficiently high level for the Zener voltage, a very reliable distribution of current can be achieved. However, energy losses in the circuit also increase in line with a rising Zener voltage level. This means that in dimensioning the circuit, the Zener voltage level has to be chosen according to the operating parameters and the tolerance of the lamps.

In the embodiment according to FIG. 3, the base current for all transistors of a half cycle is supplied by one lamp channel and thus the current flowing through the lamp of this channel decreases. The base current of a conventional transistor is typically less than the collector current by a factor of 100 and provided not too many channels are used, this does not present any problem for balanced current distribution. In the circuit according to FIG. 3, two Zener diodes are needed for each lamp channel.

Figure 4:
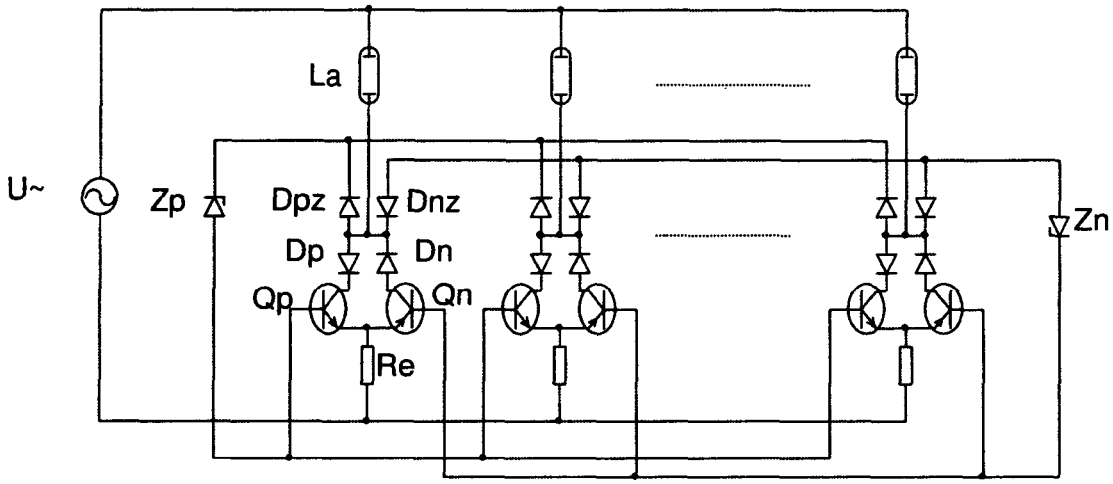
FIG. 4 schematically shows an embodiment modified with respect to FIG. 3 of a circuit for balancing a current using semiconductor circuits. Only one Zener diode for each positive and negative current branch is used.

In a further preferred embodiment of the invention according to FIG. 4, the number of Zener diodes Zp and Zn required can be reduced to a total of two, one for the positive and one for the negative half cycle of the supply voltage U~. However, in place of the Zener diodes thus saved, several conventional diodes are required. The functionality of the basic circuit of FIG. 3 is not changed by the variation shown in FIG. 4, although this variant does offer topological advantages for the circuit and cost advantages since normal diodes are less expensive than Z diodes.

For each channel, four diodes Dp, Dpz and Dn, Dnz are required. The current of the positive half cycle of the supply voltage U~ arrives back at the voltage source via the gas discharge lamp La, the diode Dp, the transistor Qp and the resistor Re. For the negative half cycle, the current flows back to the voltage source via the lamp, the diode Dn, the transistor Qn and the resistor Re. The Zener diode Zp for the positive half cycle can be triggered via the diode Dpz of each channel, the Zener diode Zn for the negative half cycle can be triggered via the diodes Dnz. The diodes Dpz of all channels form a logical OR circuit, as do the diodes Dnz. The voltage across the logical diode networks has to overcome the voltage level of the Zener diodes Zp or Zn respectively plus the voltage drop at the respective diode Dpz or Dnz. The channel that has the highest voltage, i.e. the lamp having the lowest impedance and thus the lowest voltage drop at the lamp, switches through the Zener diode Zp or Zn respectively and provides the base current for the transistors Qp or Qn respectively.

In the embodiment of the circuit revealed in FIG. 4, the voltage drops across the emitter resistors Re are always the same, even when the lamp currents are no longer the same, since, for example, the collector-emitter voltage drop at one of the transistors Qp or Qn respectively approaches zero (saturation region).

Figure 5:
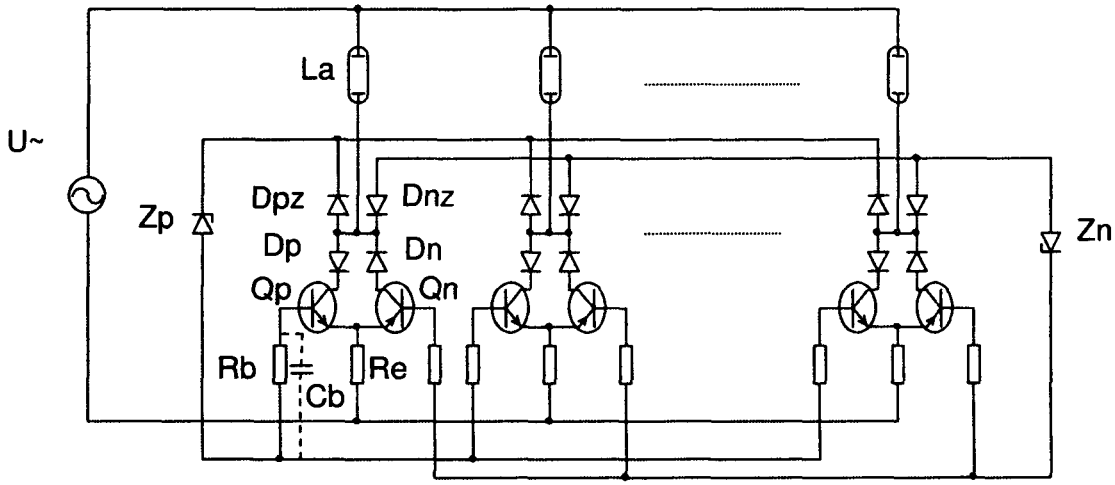
FIG. 5 schematically shows an embodiment modified with respect to FIG. 4 of a circuit for balancing a current using semiconductor circuits. Base resistors at the transistors are used. Capacitors may also be connected in parallel to the base resistors.

By introducing additional base resistors Rb at the transistors Qp and Qn according to FIG. 5, disturbances in the current distribution are also made visible by the voltage drops at the emitter resistors. As long as the circuit function is "normal", i.e. no transistor operates in the saturation region, the base current is correspondingly small and only a very small voltage drop occurs at the base resistor Rb. However, as soon as a transistor enters saturation and more current flows across this base, more voltage also drops at this base resistor Rb. The base potential of this transistor operating in the saturation region is thereby no longer identical to the base potential of the other transistors. When the base potential changes, the current across the emitter resistor Re changes and thus the voltage drop as well. This voltage drop can be measured. The measured result could be advantageous for subsequent monitoring circuits. The base resistors Rb do not impair the distribution of current provided that they are not significantly larger than the emitter resistors Re. The dynamic behavior of the circuit can be improved by capacitors Cb parallel to each base resistor Rb.

Figure 6:
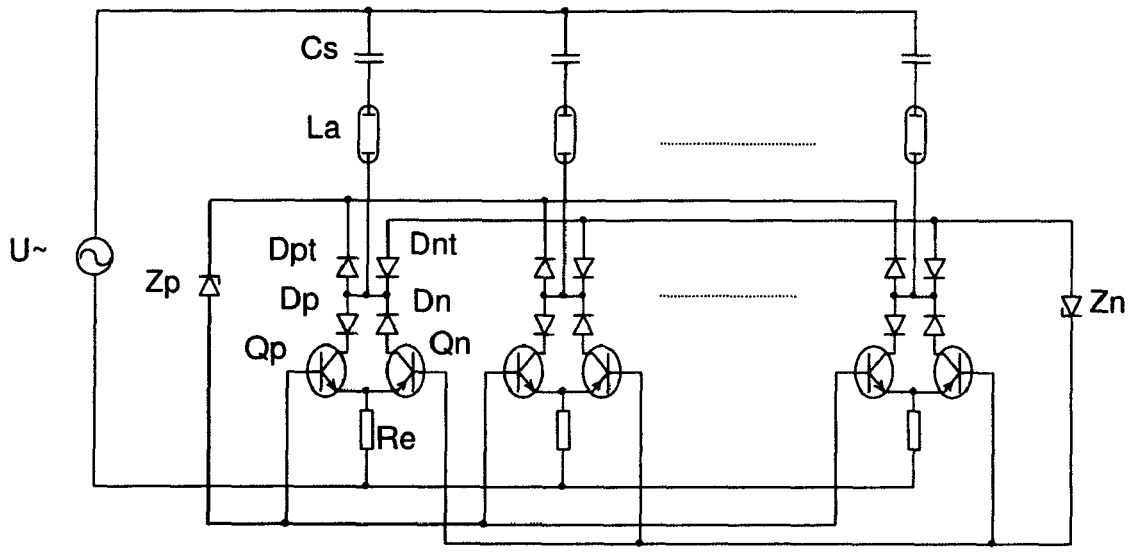
FIG. 6 schematically shows an embodiment modified with respect to FIG. 4 of a circuit for balancing a current using semiconductor circuits. Capacitors for balancing the charge of the lamp currents are used.

A further embodiment of the circuit for distributing the current is illustrated in FIG. 6 and includes a balancing capacitor Cs connected in series to each of the lamps La. The capacitor Cs ensures that the positive and negative charge quantities that are transported through the lamp are exactly the same, thus making it possible to maximize the useful life of the lamp. Since the capacitors Cs only allow alternating components to pass, this ensures that the charge quantity that passes through the capacitor Cs in one direction is exactly the same as the charge quantity that passes through the capacitor Cs in the other direction.

All the circuit variants presented in FIGS. 3 to 6 have the advantage that they do not need any additional outside voltage source other than the supply voltage U~, since the base currents for the transistors Qp and Qn are derived from the lamp currents. As long as the required base currents are small compared to the lamp currents, this does not represent any serious impairment of the distribution of current. However, if the number of lamps La is large and/or the current amplification of the transistors is low, this feature signifies a limitation.

Figure 7:
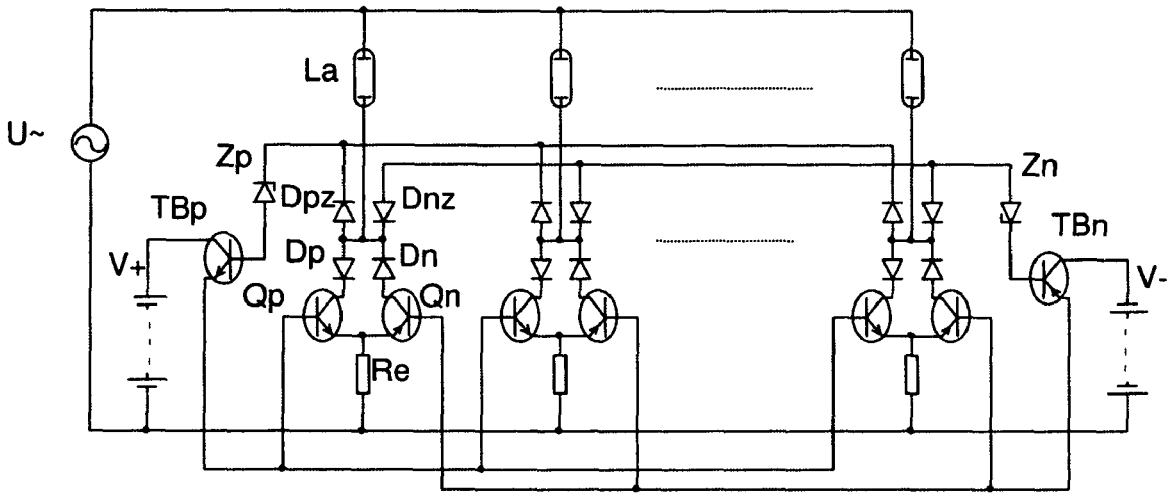
FIG. 7 schematically shows an embodiment modified with respect to FIG. 4 of a circuit for balancing a current using semiconductor circuits. An external auxiliary voltage source to supply the base currents is used.

This limitation can be overcome by the supplementary circuit element shown in FIG. 7 having transistors TBp and TBn. The transistors TBp and TBn act as current amplifiers. The base currents for the transistors Qp and Qn of the lamp branches are now drawn from two external auxiliary voltage sources (V+, V−). Only a residual current, reduced by the current amplification of the transistors TBp or TBn respectively, now flows across the respective Zener diode Zp or Zn, thus de facto preventing the base currents of the transistors Qp and Qn from influencing the current distribution of the lamp currents.

In another preferred embodiment a resistor can be connected between the base and emitter terminals of TBp and parallel to this a capacitor, in order to increase interference resistance. The same supplementary circuit element can also be used for TBn.

Figure 8:
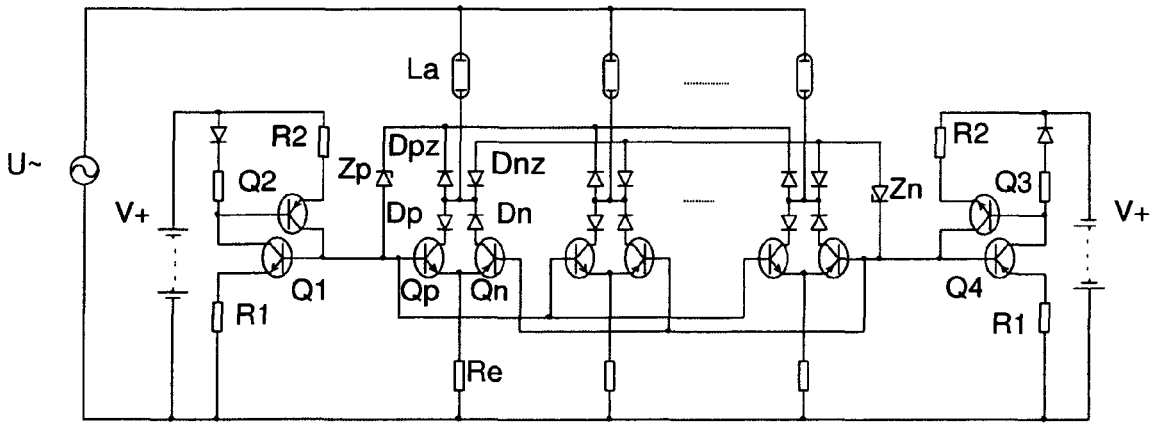
FIG. 8 schematically shows a further embodiment of a circuit for balancing a current using semiconductor circuits. An additional current mirror circuit to supply the base currents is used.

All the embodiments previously described in FIGS. 3 to 7 of the current distribution circuit require a compromise in the choice of the voltage level of the Zener diodes Zp and Zn. A higher voltage level extends the tolerance range of the circuit but also increases its energy losses. Experience shows that the Zener voltage level required for a reliable distribution of current falls as the lamp La heats up. The Zener voltage level could therefore be reduced after the heating-up phase of the lamp, thus allowing the lamp to be operated at a higher level of efficiency. Similar considerations could also be applied to varying environmental temperatures. To maximize efficiency, a circuit element is thus required that acts like a Zener diode but whose Zener voltage adapts dynamically to the actual operating conditions of the lamp. This kind of behavior is achieved by the circuit element described below in FIG. 8. FIG. 8 is based on the basic circuit according to FIG. 4.

The transistors Q1 and Q2 and likewise Q3 and Q4 illustrated in FIG. 8 form multiplying current mirror circuits that feed back a small part of the emitter currents of the balancing circuit to the common base terminals of the transistors Qp or Qn respectively. The proportion of the returned current can be determined by the size of the resistors R1 and R2. Provided that the returned current is smaller than the overall base current of the interconnected transistors Qp or Qn respectively, the new circuit element only relieves the Zener diode Zp or Zn respectively, since these now only need deliver a part of the base current for the transistors Qp or Qn respectively. However, should the current mirror circuit be so dimensioned that the returned current exceeds the necessary common base current of the interconnected transistors Qp or Qn respectively (loop amplification>1), an operating point drift sets in due to the positive feedback until one transistor each of the npn transistors Qp and one transistor each of the pnp transistors Qn operates in the saturation region and becomes so conductive that its current amplification falls massively until the respective loop amplification again equals 1. This goes to ensure that under each operating condition, the voltage drop at each transistor Qp or Qn respectively almost disappears. The voltage drops at the other transistors are just large enough that the same current flows in each channel. This results in an automatic self-adjustment of the circuit to the maximum level of efficiency.

The functioning of the current mirror circuit is now described on the basis of the circuit element of a lamp branch responsible for the positive half cycle of the input alternating current. The functioning of the circuit element responsible for the negative half cycle of the input alternating current is identical. The transistor Q1 forms a current mirror whose emitter current is determined by the value of the resistor R1. If the resistor R1 is the same size as the resistor Re in the lamp branches, then the current through R1 is also the same size as through Re. If a different resistor R1 is used, a multiplying current mirror is obtained whose emitter current is only a third or a tenth, for example, of the current in the lamp branches. The transistor Q2 forms another current mirror that practically mirrors the collector current of Q1 once again, depending on R2. Ultimately, a current from Q2 is fed in at the node at the base of Q1, the current from Q2 being proportional to the lamp current in the individual lamp branches (lamp current multiplied by a factor such as 0.1 or 0.01). According to the invention, the current mirror is now dimensioned such that the base current at Q1 is somewhat larger than the common base current for the transistors Qp supplied through the Zener diode Zp, so that the current through the Zener diode Zp is zero. From this point, the circuit starts to drift, it becomes unstable in that the current mirror feeds back more current than is actually needed in order to make the current through the Zener diode Zp cease. As a result, the base potential at the interconnected bases of Qp rises and the transistors Qp become conductive. The circuit trips, and the transistors Qp become increasingly conductive and this continues until one of the transistors Qp enters saturation. The transistor entering saturation draws more strongly on the current delivered by the current mirror and the process becomes more stable. At this point, one of the transistors Qp is fully conductive (entering saturation) and has very low impedance. The other transistors Qp of the group are less conductive and have greater collector-emitter resistance. This condition is crucial for improving the level of efficiency of the circuit. For that transistor Qp, which has entered saturation, the voltage drop between the collector and the emitter is minimal and for the other transistors somewhat larger. The power losses in the transistors Qp are thereby minimized.

The (multiplying) current mirror consequently has the same effect as a Zener diode whose voltage level is precisely adjusted such that a transistor Qp only just approaches saturation. The Zener diode Zp is no longer needed as soon as the effect of the current mirror circuit becomes noticeable, since no current flows through the Zener diode Zp after this point in time. To start the process, however, an initial current is needed which is supplied through the Zener diode Zp. However, as soon as the process is started, the Zener diode Zp becomes superfluous. The same description and functioning applies to the Zener diode Zn and the associated current mirror, formed by the transistors Q3 and Q4.

In all the above-mentioned possible applications of the circuit according to the invention, the positive half cycle of the lamp current is carried via npn transistors Qp and the negative half cycle via pnp transistors Qn. It is possible, however, to modify the circuit such that only npn or only pnp transistors are used.

Figure 9:
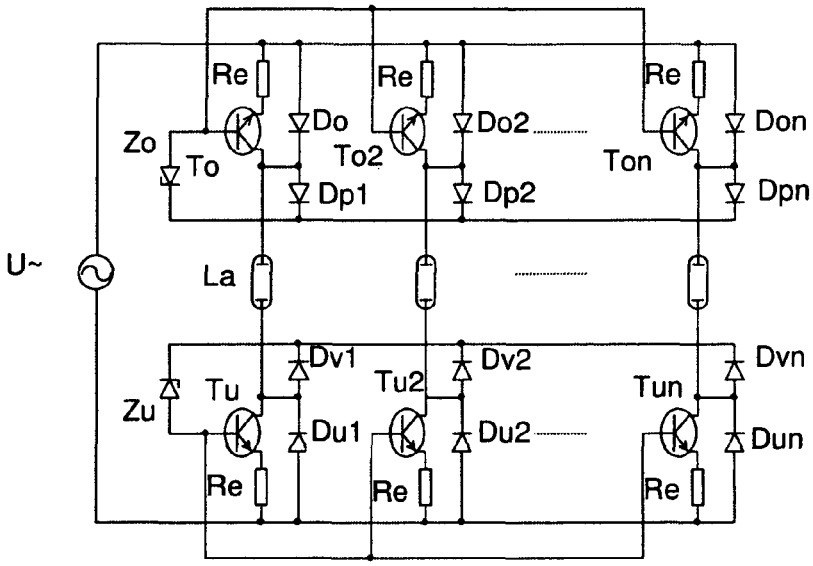
FIG. 9 shows a further embodiment of a circuit for balancing a current using semiconductor circuits. Only transistors of the same type (npn) are used.

In FIG. 9 a circuit for current balancing using only npn transistors To1 . . . Ton is presented. A similar circuit is also possible for pnp transistors when all the diode polarities are inverted. The variant of the circuit having only npn transistors To1 . . . Ton is advantageous in that npn transistors are generally more reasonably priced than pnp transistors.

In FIG. 9, the positive half cycle of the input alternating voltage U~ (described by way of example for the first lamp branch) returns via the diode Do1 past transistor To1, via the lamp La to transistor Tu1 and resistor Re back to the voltage source. At the same time, the positive half cycle arrives via diode Dv1 at Zener diode Zu. The negative half cycle of the input alternating voltage U~ is conducted via a diode Du1 past transistor Tu1 and returns via the lamp La to transistor To1 and resistor Re back to the voltage source. At the same time, the negative half cycle arrives via diode Dp1 at Zener diode Zo. The functioning of the circuit according to FIG. 9 otherwise corresponds to the circuit of FIG. 4.

Figure 10:
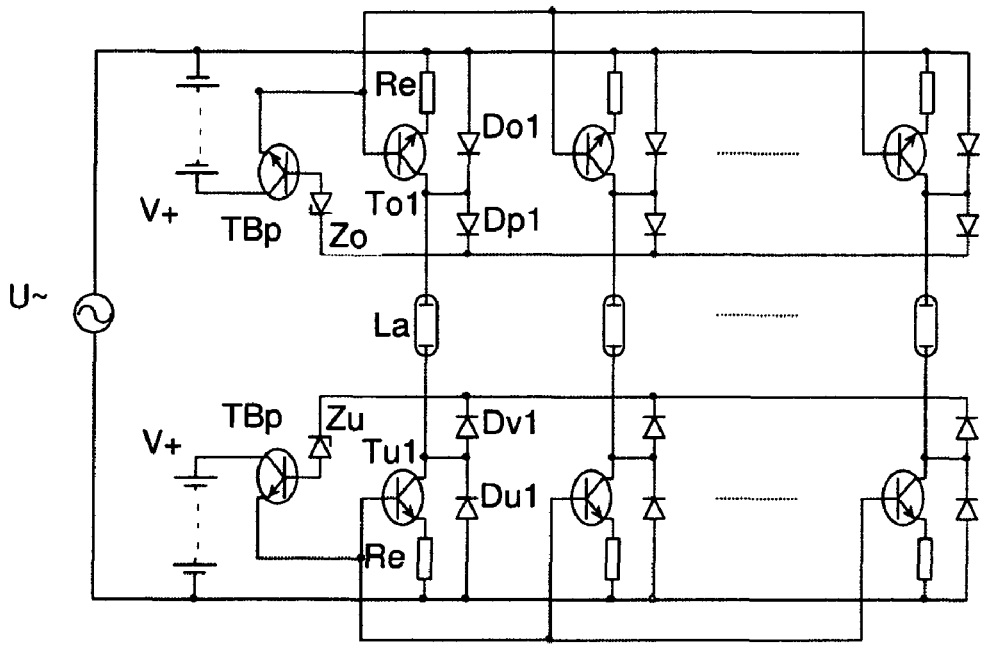
FIG. 10 schematically shows an embodiment modified with respect to FIG. 9 of a circuit for balancing a current using semiconductor circuits. An external auxiliary voltage source to supply the base currents is used.

FIG. 10 shows the circuit of FIG. 9 having an additional amplifier circuit for the Zener diode current. The amplifier circuit consists of two transistors TBp that are each associated with the Zener diodes Zo and Zu and each operated at an auxiliary voltage source V+. The base currents for the transistors Tu1 and To1 of the lamp branches are now drawn from the external auxiliary voltage sources V+. The functioning of the amplifier circuit is described in conjunction with FIG. 7.

Figure 11:
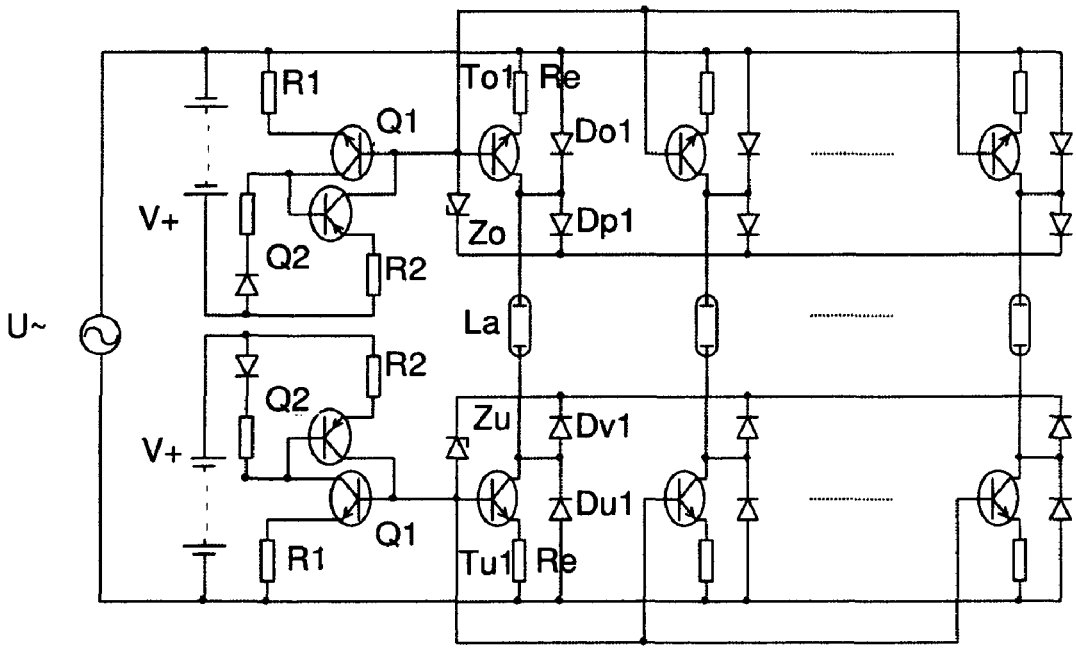
FIG. 11 schematically shows an embodiment modified with respect to FIG. 9 of a circuit for balancing a current using semiconductor circuits. An additional current mirror circuit to supply the base currents is used.

FIG. 11 shows the application of the supplementary circuit element of FIG. 8 to the circuit of FIG. 9.

The additional circuits to improve the distribution of current and level of efficiency used in FIG. 10 and FIG. 11 can also be used in other advantageous embodiments at the same time (alongside each other).

The invention claimed is:

1. An electronic circuit to operate a plurality of gas discharge lamps (La) at a common alternating voltage source (U~) for the defined distribution of current to the individual branches, comprising a: the alternating current through each lamp (La) is separated into its positive and negative half cycles by means of diodes (Dp, Dn) and b: the positive half cycle is conducted back via the collector-emitter section of an npn transistor (Qp) and an emitter resistor (Re) to the ac voltage source, and c: the negative half cycle is conducted back via the collector-emitter section of a pnp transistor (Qn) and an emitter resistor (Re) to the voltage source, and d: the base terminals of all npn transistors (Qp) are electrically connected directly to one another or are connected via individual base resistors (Rb) to one another and e: the base terminals of all pnp transistors (Qn) are electrically connected directly to one another or connected via individual base resistors (Rb) to one another and f: the common base currents for the transistors (Qp; Qn) derived from the lamp current of a gas discharge lamp (La) have to overcome a potential step provided by an element comprising a Zener diode (Zp; Zn).

2. An electronic circuit according to claim 1, characterized in that each of the transistors (Qp; Qn) has an element (Zp; Zn) or a circuit element between the base terminal and collector terminal that generates a voltage potential step and has high impedance below a specific voltage potential and low impedance above.

3. An electronic circuit according to claim 1, characterized in that for the first group of transistors (Qp) interconnected at their bases only one common element (Zp) or circuit element generating a voltage potential step is used, and likewise for the second group of transistors (Qn) interconnected at their bases only one common element (Zn) or circuit element generating a voltage potential step is used.

4. An electronic circuit according to claim 1, characterized in that the base terminal of each transistor (Qp; Qn) is connected to the rest of the circuit via a resistor (Re) or via a resistor (Rb) having a capacitor (Cb) connected in parallel to it.

5. An electronic circuit according to claim 1, characterized in that for balancing the charge in each lamp current branch associated with a gas discharge lamp (La), a capacitor (Cs) is connected in series to the gas discharge lamp.

6. An electronic circuit according to claim 1, characterized in that the base currents for the transistors (Qp; Qn) interconnected at their bases are supplied by external voltage sources (V+; V−) via an additional transistor (TBp; TBn), which is connected at its base terminal to the element (Zp; Zn) that generates a voltage potential step.

7. An electronic circuit according to claim 1, characterized in that using an additional circuit taking the form of a multiplying current mirror (Q1, Q2; Q3; Q4) a small fraction of the emitter currents of the lamp current branches is conducted back to the base terminals.

8. An electronic circuit to operate a plurality of gas discharge lamps (La) at a common alternating voltage source (U~) for the defined distribution of current to the individual lamp branches, comprising a: for each gas discharge lamp, a half cycle of the input ac voltage is conducted via a first diode (Do) through the lamp (La) and a first transistor (Tu) and the other half cycle is conducted via a second diode (Du) through the lamp (La) and a second transistor (To)

b: the base terminals of all second transistors (Tu1 . . . Tun) are electrically connected directly to one another or connected to one another via individual base resistors and c: the base terminals of all second transistors (To1 . . . Ton) are electrically connected directly to one another or connected to one another via individual base resistors and d: the common base currents of the transistors (To1 . . . Ton; Tu1 . . . Tun) derived from the lamp current of a gas discharge lamp (La) have to overcome a potential step provided by an element comprising a Zener diode (Zo; Zu).

9. An electronic circuit according to claim 8, characterized in that each of the transistors (To1 . . . Ton; Tu1 . . . Tun) has an element (Zo; Zu) or circuit element between the base and collector terminal that generates a voltage potential step and has high impedance below a specific voltage potential and low impedance above.

10. An electronic circuit according to claim 8, characterized in that for the first group of transistors (To1 . . . Ton) interconnected at their bases only one common element (Zo; Zu) or circuit element that generates a voltage potential step is used, and for the second group of transistors (Tu1 . . . Tun) interconnected at their bases only one common element or circuit element that generates a voltage potential step is used.

11. An electronic circuit according to claim 8, characterized in that the base terminal of each transistor (To1 . . . Ton; Tu1 . . . Tun) is connected to the rest of the circuit via a resistor or via a resistor having a capacitor connected in parallel to it.

12. An electronic circuit according to claim 8, characterized in that for balancing the charge in each lamp current branch associated with a gas discharge lamp, a capacitor is connected in series to the gas discharge lamp.

13. An electronic circuit according to claim 8, characterized in that the base currents for the transistors (To1 . . . Ton; To1 . . . Ton) interconnected at their bases are supplied by external voltage sources (V+) via an additional transistor (TBp) which is connected at its base terminal to the element (Zo; Zu) that generates a voltage potential step.

14. An electronic circuit according to claim 8, characterized in that using an additional circuit taking the form of a multiplying current mirror (Q1, Q2; Q3, Q4) a small fraction of the emitter currents of the lamp current branches is conducted back to the base terminals.

* * * * *